US012421629B2

(12) United States Patent
Poulsen

(10) Patent No.: US 12,421,629 B2
(45) Date of Patent: Sep. 23, 2025

(54) APPARATUS FOR MANUFACTURING FIBERS BY ELECTROSPINNING

(71) Applicant: JSBP HOLDING APS, Sakskobing (DK)

(72) Inventor: Jorgen Bech Poulsen, Sakskobing (DK)

(73) Assignee: JP AIR TECH APS, Sakskobing (DK)

( * ) Notice: Subject to any disclaimer, the term of this patent is extended or adjusted under 35 U.S.C. 154(b) by 493 days.

(21) Appl. No.: 17/772,012

(22) PCT Filed: Oct. 21, 2020

(86) PCT No.: PCT/EP2020/079623
§ 371 (c)(1),
(2) Date: Apr. 26, 2022

(87) PCT Pub. No.: WO2021/083762
PCT Pub. Date: May 6, 2021

(65) Prior Publication Data

US 2022/0372657 A1 Nov. 24, 2022

(30) Foreign Application Priority Data

Oct. 28, 2019 (DK) ..... PA 2019 01264

(51) Int. Cl.
*D01D 5/00* (2006.01)

(52) U.S. Cl.
CPC ..... *D01D 5/003* (2013.01); *D01D 5/0069* (2013.01); *D01D 5/0076* (2013.01)

(58) Field of Classification Search
CPC ..... D01D 5/003; D01D 5/0069; D01D 5/0076
See application file for complete search history.

(56) References Cited

U.S. PATENT DOCUMENTS

| | | | |
|---|---|---|---|
| 7,967,588 | B2 | 6/2011 | Green et al. |
| 8,231,822 | B2 | 7/2012 | Petras et al. |
| 11,085,132 | B2 | 8/2021 | Jin et al. |
| 2009/0126333 | A1 | 5/2009 | Green et al. |
| 2015/0174806 | A1* | 6/2015 | Wong ..... D04H 1/728 442/366 |

FOREIGN PATENT DOCUMENTS

| | | | |
|---|---|---|---|
| CN | 104480640 | A | 4/2015 |
| CN | 103215661 | B | 4/2016 |

(Continued)

OTHER PUBLICATIONS

Bibliographic Data including English Abstract for CN 104480640 A, 1 page.
Bibliographic Data including English Abstract for CN 105568409 A, 1 page.

(Continued)

*Primary Examiner* — Galen H Hauth
*Assistant Examiner* — Mohamed K Ahmed Ali
(74) *Attorney, Agent, or Firm* — Francis J. Maguire; WARE FRESSOLA MAGUIRE & BARBER LLP

(57) ABSTRACT

A sheet of substrate (7) travels along a first path in a first direction between a first collecting electrode (1) and a second spinning wire electrode (2); and the second spinning wire electrode (2) travels in a second direction (10) approximately perpendicular to the first direction at an approximately constant operational distance to the sheet of substrate (7). One or more secondary guiding means (4) guide the second spinning wire electrode (2) in a third direction at least partly parallel to the first direction i.e. parallel to the traveling direction of the sheet of substrate, and tertiary guiding means (5) guide the second spinning wire electrode (2) in a fourth direction (11) approximately perpendicular to the first direction and parallel but opposite the second direction (10) at a constant operational distance to the sheet of substrate (7).

9 Claims, 3 Drawing Sheets

.com

(56) References Cited

FOREIGN PATENT DOCUMENTS

| | | | | |
|---|---|---|---|---|
| CN | 105568409 | A | * | 5/2016 |
| CN | 206319086 | U | | 7/2017 |
| CN | 110216089 | A | | 9/2019 |
| WO | 2009/010020 | A2 | | 1/2009 |
| WO | 2009/067368 | A2 | | 5/2009 |
| WO | 2018/129244 | A1 | | 7/2018 |
| WO | 2018/203182 | A1 | | 11/2018 |
| WO | 2019/124663 | A1 | | 6/2019 |

OTHER PUBLICATIONS

Bibliographic Data including English Abstract for CN 110216089 A, 1 page.
International Search Report (ISR), PCT/EP2020/079623, mailed Feb. 2, 2021, 4 pages.
Written Opinion of the International Searching Authority (ISA/EP), mailed Feb. 2, 2021, 6 pages.
Third Party (anonymous) Observation (PCT Administrative Instructions Part 8) for international application No. PCT/ EP2020/079623, dated Sep. 21, 2021, 3 pages.
Additional comments submitted with observation for international application No. PCT/EP2020/079623, dated Sep. 21, 2021, 8 pages.
Danish Patent and Trademark Office, Search Report for Patent Application PA 2019 01264, completed Apr. 28, 2020, 4 pages.
English Abstract and description, Chinese Patent 103215661 B, published Jul. 11, 2017, 10 pages.
Bibliographic Data including English Abstract, Patent Application No. CN206319086U, published Nov. 7, 2017, 2 pages.

* cited by examiner

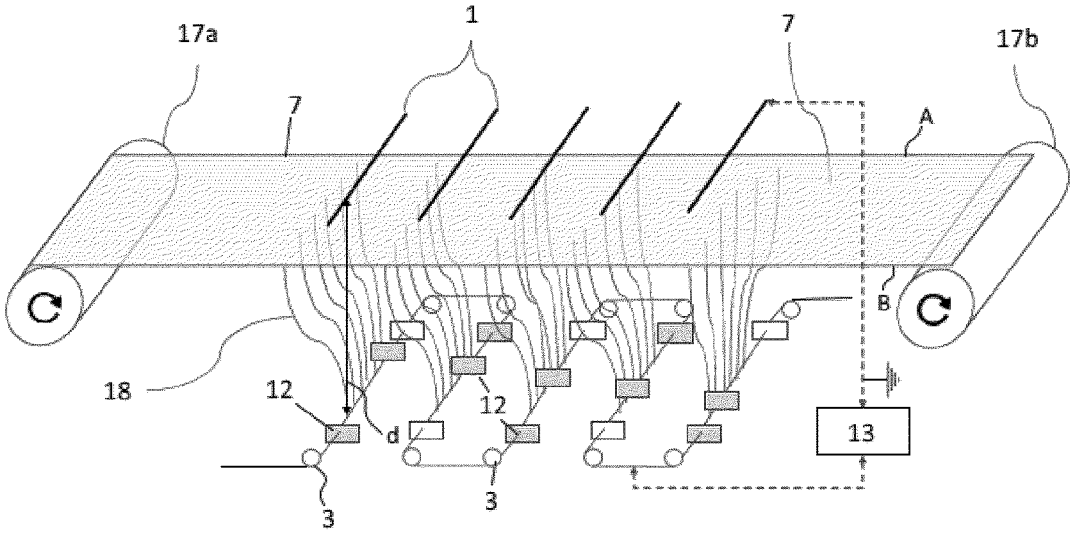
Figure 3
Figure 4A:
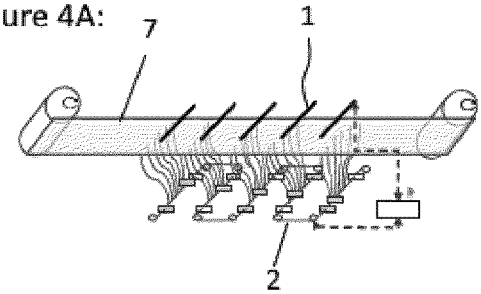
Figure 4B:
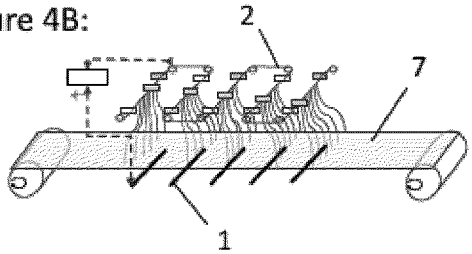
Figure 4C:
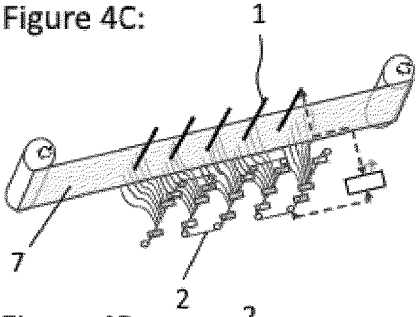
Figure 4D
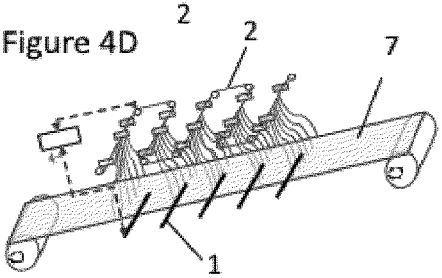

APPARATUS FOR MANUFACTURING FIBERS BY ELECTROSPINNING

BACKGROUND ART

The present invention relates to an apparatus for producing fibers such as nanofibers by electrospinning liquid matrix in an electrostatic field.

More than one apparatus for producing fibers by electrospinning liquid matrix is known e.g. from the two documents discussed below.

WO 2009/010020 A2 (U.S. Pat. No. 8,231,822 B2) relates to a method for spinning the liquid matrix (38) in an electrostatic field between at least one spinning electrode (3) and against it arranged collecting electrode (4), while one of the electrodes is connected to one pole of high voltage source and the second electrode is connected to opposite pole of high voltage source or is grounded, at which the liquid matrix (38) being subject to spinning is to be found in electrostatic field on the active spinning zone (3100) of the cord (310) of the spinning means (31) of the spinning electrode (3). The active spinning zone (3100) of the cord during spinning process has a stable position towards the collecting electrode (4) and the liquid matrix (38) to the active spinning zone (3100) of the cord is delivered either by application to the active spinning zone (3100) of the cord or by motion of the cord (310) in direction of its length. The invention further relates to the device for production of nanofibers and to the spinning electrode (3), whose active spinning zone (3100) of the cord in the carrying body (32) of the spinning electrode (3) has a stable position and to the cord (310) there is assigned the device (37) for application of the liquid matrix (38) to the cord (310), which is arranged in the carrying body (32) of the spinning electrode (3).

WO 2009/067368 A2 (U.S. Pat. No. 7,967,588 B2) relates to an equipment for electrostatic fine fiber generation such as for forming nanofibers from polymer solution is provided. The fine fiber generation equipment includes a strand that may take the form of a stainless-steel beaded chain. The beaded chain can be an endless chain entrained upon two guide wheels and driven about an endless path perpendicularly relative to the collection media. More particularly, the document relates to an apparatus according to the document comprises: a first electrode; a second electrode spaced from the first electrode, the second electrode including a strand entrained upon at least two guides; an entrance region and an exit region spaced apart along a first path, wherein the collection media is adapted to be driven along the first path from the entrance region to the exit region in spaced relation from the second electrode; a drive unit adapted to drive the strand, along the at two guides for movement along a second path that is transverse to the first path; a voltage source arranged to generate a voltage differential between the first and second electrodes for generating the spinning of fine fibers.

Equipment according to this known prior art has multiple independent wires placed between a first and a second side of the electrostatic field.

SUMMARY OF INVENTION

An apparatus according to the present invention comprises only one wire with spring loading which gives equal tension control on each region thus improving homogeneity on nanofiber production both in cross direction and machine direction, i.e. the direction in which the substrate is moved forward.

The present invention provides one sophisticated system with which it is possible to control all wire parameters thus making the system cheaper than other systems.

According to the present invention, there is no mechanical obstacle to put wires closer so that this system offers compact features with higher throughput.

The object of the present invention is therefore to provide a more efficient and less expensive apparatus for electrospinning of polymer.

According to the present invention a single wire is used as a spinning electrode in an apparatus section to generate fibers.

According to one aspect of the invention, the present invention relates to an apparatus for producing fibers by electrospinning liquid matrix in an electrostatic field onto a sheet of substrate, which apparatus comprises:

- a first collecting electrode;
- a second spinning wire electrode spaced from the first collecting electrode, the second spinning wire electrode comprises a moving strand or wire guided by first guiding means;
- a wire driving unit moving the second spinning wire electrode forward; and
- a liquid matrix application device applying liquid matrix to the second spinning wire electrode;

the sheet of substrate travels along a first path in a first direction between the first collecting electrode and the second spinning wire electrode; and the second spinning wire electrode travels in a second direction approximately perpendicular to the first direction at an approximately constant operational distance to the sheet of substrate; wherein the apparatus comprises secondary guiding means guiding the second spinning wire electrode in a third direction parallel or at least partly parallel to the first direction i.e. at least partly parallel to the travelling direction of the sheet of substrate, and tertiary guiding means guiding the second spinning wire electrode in a fourth direction approximately perpendicular to the first direction and parallel but opposite the second direction at a constant operational distance to the sheet of substrate.

According to any embodiment of the invention, the apparatus may comprise a wire cleaning device removing wet or dry liquid matrix from the second spinning electrode.

According to any embodiment of the invention, the apparatus may comprise one or more vacuum heads positioned in connection with each or at least some of the wire cleaning device(s) removing cleaned/peeled of dry or wet liquid matrix.

According to any embodiment of the invention, the liquid matrix application device may be constituted of one or a plurality of nozzles applying liquid matrix to the surface of the second spinning wire electrode, while the electrode passes a stationary nozzle.

According to any embodiment of the invention, the nozzle(s) may be fixed at the side of the sheet of substrate (side A or side B), and/or the nozzle(s) may be placed in between each side of the sheet of substrate e.g. with specific intervals from the wire axis.

According to any embodiment of the invention, the second spinning wire electrode may be made by stainless steel or similar conductive material such as copper or aluminum, and optionally have a diameter in the range of 0.1-10 mm.

According to any embodiment of the invention, the liquid matrix may be a polymer solution prepared by using one or a combination of polymers PA6, PA66, PA12, PAN, PU, PES, PEO, PET, PP, PE, PVDF, PUR, and using a solvent chosen from acetic acid, formic acid, ethanol, tetrahydrofuran, DMA and/or DMF.

According to any embodiment of the invention, the apparatus may comprise an un-winding unit feeding the second spinning wire electrode to a first guiding means and a winding unit collecting used second spinning wire electrode after a tertiary guiding means, where either the un-winding unit or the winding unit may constitute the wire driving unit.

According to any embodiment of the invention, the second spinning wire electrode is constituted of a continuous wire which is continuously driven round through the apparatus by a wire driving unit.

According to a second aspect of the invention, the invention relates to a method for producing nanofibers by electrospinning from a liquid matrix in an electrostatic field by use of an apparatus according to the first aspect.

BRIEF DESCRIPTION OF THE DRAWINGS

FIG. 3 discloses a perspective view of an embodiment of an apparatus according to the invention.

FIGS. 4A, 4B, 4C and 4D disclose different embodiments of an apparatus according to the invention.

Throughout the application identical elements or elements having identical function for different embodiments are given the same reference numbers.

Definitions of Words

In general—when this expression is used in respect of a feature, the feature may be employed with any embodiment of the invention, even though the specific mentioning appears in the detailed part of the description.

At least partly parallel—when a secondary direction is at least partly parallel with a primary direction it means that a vector v describing the secondary direction has a scalar projection larger than 0 onto the primary direction, the scalar projection being the magnitude of the vector projection.

DETAILED DESCRIPTION OF INVENTION

The present invention relates to an apparatus for producing fibers such as nanofibers by electrospinning liquid matrix in an electrostatic field. The function of the apparatus is to generate fibers such as nanofibers from the surface of the second spinning wire electrode under a high electrical field. In a high electrical field, electrostatic forces overcome the surface energy of the liquid matrix droplets placed on the second spinning wire electrode and liquid matrix is attracted towards a first collecting electrode 1. Fibers such as nanofibers can be generated from different polymers (PA6, PVDF, PUR, PAN, etc.) or polymer solutions, and fibers at different diameter (20-750 nm) may be formed.

Figure 1:
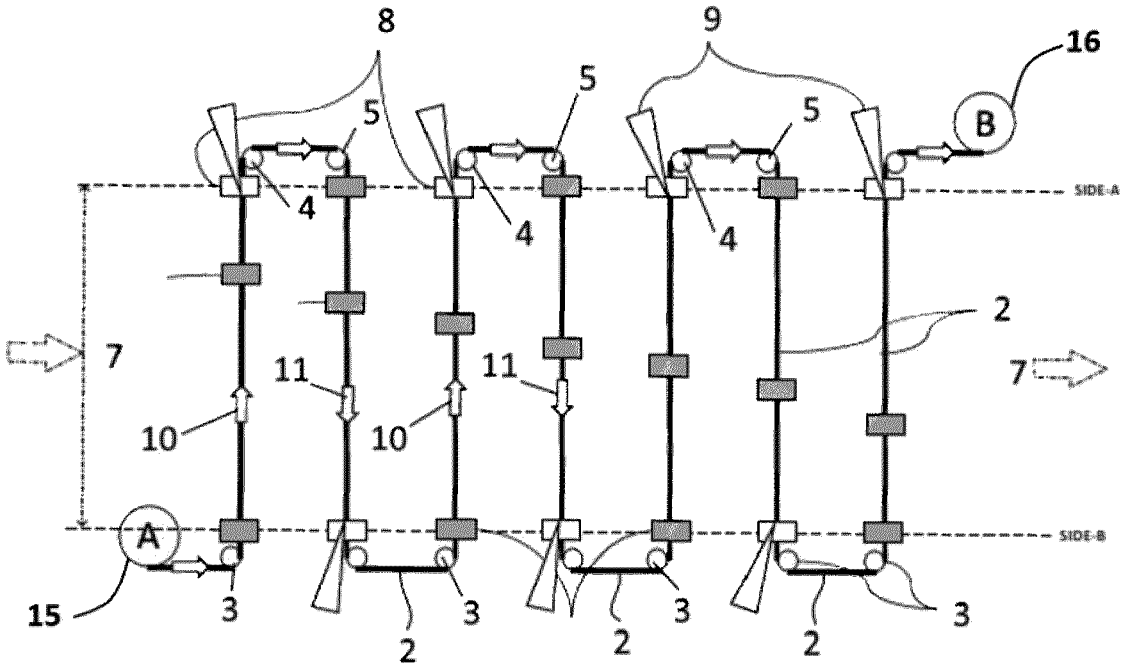
FIG. 1 discloses a top view of a first embodiment of an electrode arrangement of an apparatus according to the invention where a spinning wire electrode unwind at point A and wind at point B.
Figure 2:
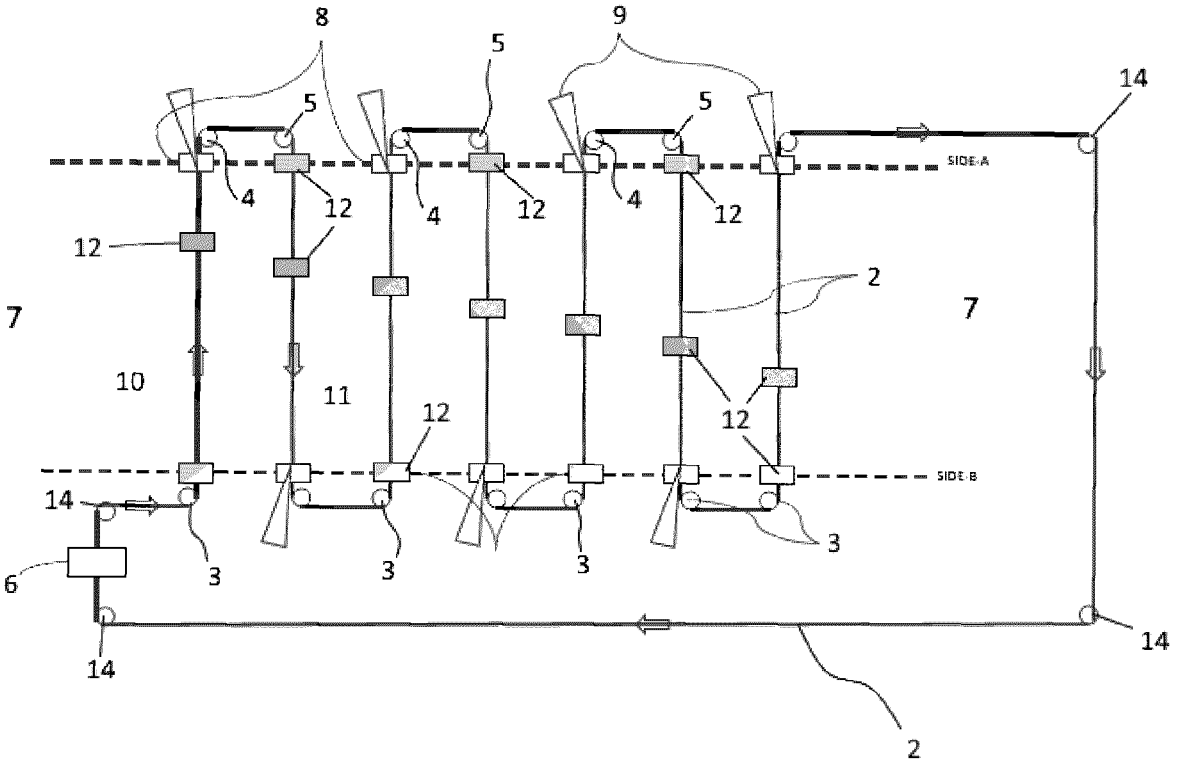
FIG. 2 discloses a top view of a second embodiment of an electrode arrangement of an apparatus according to the invention where a spinning wire electrode continuously wind round through the system.

FIG. 1 and FIG. 2 disclose top views of two different embodiments of an apparatus according to the invention. Parts with identical function are numbered with identical reference numbers. The embodiment of FIG. 1 disclose how the second spinning wire electrode may be held and distributed from one position while received and captured at a second position, whereas the embodiment of FIG. 2 disclose how the second spinning wire electrode may be formed as a continuous endless loop which is guided back to the starting position.

The apparatus comprises a first collecting electrode 1 and a second spinning wire electrode 2, the two electrodes 1, 2 are spaced from each other at an operational distance d which distance contributes to obtaining desired fibers. The second spinning wire electrode 2 comprises or is constituted of a moving strand or wire guided by first guiding means 3, these first guiding means may be guiding rollers or similar. The apparatus further comprises a wire driving unit 6 which unit forces or moves the second spinning wire electrode 2 forward. An operational area is present in an area between the first collecting electrode 1 and the second spinning wire electrode 2. A high voltage is applied between the first collecting electrode 1 and the second spinning wire electrode 2 to create an electrical field where electrostatic forces attract the fibers from the polymer solution from the surface of the second spinning wire electrode. There may be more than one collecting electrode for each spinning wire electrode.

A sheet of substrate 7 travels along a first path inside the apparatus in a first direction between the first collecting electrode 1 and the second spinning wire electrode 2. In FIG. 1 the position of the sheet of substrate 7 is illustrated by dotted lines, side A and side B and the moving direction of the substrate i.e. the first direction is illustrated with dotted-line arrows. A sheet of substrate is a base media and may comprise any kind of nonwoven i.e. spunbond, meltblown, wetlaid, textile fabric etc. with basis weight in the range of 10-500 g/m2 and generated nanofibers are collected on the surface of the sheet of substrate.

The second spinning wire electrode 2 travels or moves forward in a second direction, illustrated by arrow 10, approximately perpendicular to the first direction in which the substrate moves. The second spinning wire electrode 2 moves parallel to the sheet of substrate and maintains an approximately constant operational distance to the sheet of substrate 7 at positions where the second spinning wire electrode is operational i.e. working by spinning fibers. That the distance is "approximately constant" means that the distance between the sheet of substrate 7 and the second spinning wire electrode 2 is constant so that desired fibers are obtained by the process.

The apparatus further comprises secondary guiding means 4 guiding the second spinning wire electrode 2 from the second direction and into a third direction parallel to the first direction i.e. parallel to the travelling direction of the sheet of substrate 7, and tertiary guiding means 5 guiding the second spinning wire electrode 2 in a fourth direction, illustrated by arrow 11, approximately perpendicular to the first direction and parallel but opposite the second direction at a constant operational distance to the sheet of substrate. That the fourth direction is "approximately perpendicular to the first direction" means that the desired functionality is obtained. The first, secondary or tertiary guiding means may comprise or be constituted by guiding rollers which each may help the wire forward and define a new direction for the wire to move in.

The apparatus may further comprise a wire cleaning device 8 which is able to remove wet or dry liquid matrix from surface of the second spinning electrode 2. The presence of a wire cleaning device 8 increases the reliability of the apparatus and increases the number of hours between close down for maintenance of the apparatus. E.g. the second spinning wire electrode may slip fit through a wire cleaning head of the wire cleaning device 8 thereby causing the liquid matrix to mechanically peel away from the surface. Peeled liquid matrix, wet or dry, may be removed by vacuum heads 9 e.g. placed very close to the peeling position at each wire cleaning head 8.

The apparatus may also comprise vacuum heads 9 positioned in connection with each wire cleaning device 8 which vacuum head 9 removes dust and drips cleaned or peeled off by the wire cleaning device 8.

Liquid matrix must be applied to the second spinning wire electrode 2 at a position where the second spinning wire electrode is in the operational area or as the second spinning wire electrode enters into the operational area. According to an embodiment of the invention, the liquid matrix application device 12 may comprise one or more nozzles or similar spraying liquid matrix on to a surface of the second spinning wire electrode 2. The liquid matrix application device 12 may be constituted of one or a plurality of nozzles applying liquid matrix to the surface of the second spinning wire electrode 2 while the electrode passes a nozzle(s).

The liquid matrix may be a polymer or a polymer solution which polymer solution may be a combination of a polymer such as PA6, PAN, PVDF, PUR, etc. and a solvent such as acetic acid, formic acid, DMA, DMF, etc.

The second spinning wire electrode may be made e.g. by stainless steel or similar conductive material, and the electrode 2 may e.g. have a diameter in the range of 0.1-10 mm. Both material constituting the electrode 2 and the diameter of the electrode 2 will depend on what polymer or polymer solution is handled and what fiber is intended to obtain.

The apparatus according to the invention comprises a single strand second spinning wire electrode 2, but the apparatus may either comprise a single strand second wire electrode 2 which is run through the apparatus once or it may comprise a single strand second wire electrode 2 which is run through the apparatus continuously. I.e. the apparatus may comprise an un-winding unit 15 feeding the single strand second spinning wire electrode to the first of the first guiding means 3 and a winding or collecting unit 16 re-winding or collecting the used single strand second spinning wire electrode after having passed through the apparatus and after having passed first or secondary guiding means 3, 4. According to this embodiment, either the un-winding unit 15 or the winding unit 16 may constitute a wire driving unit.

Alternatively, the apparatus may comprise a second spinning wire electrode in form of an endless loop, where the second spinning wire electrode 2 is constituted by a continuous wire which is continuously driven round through the apparatus by a separate driving unit 6. Such an embodiment is illustrated in FIG. 2. This embodiment comprises guiding means 14 e.g. in the form of guiding rollers, which guide the second spinning wire electrode from the end position back to the first position.

The invention also relates to a method for producing fibers by electrospinning liquid matrix in an electrostatic field by applying an apparatus as disclosed in the present application.

In general, the apparatus according to the present invention is characterized by comprising instead of having multiple independent wires placed between SIDE-A and SIDE-B of the substrate, the apparatus of the present invention comprises a single strand of wires, or alternatively two or more groups of single strand second spinning wire electrodes, where each second spinning wire electrode crosses more than once through the operational area.

having wire cleaning heads optionally in combination with vacuum heads where the wire cleaning head may be positioned downstream of a nozzle e.g. at the side of the substrate where the second spinning wire electrode passes out of the operational area.

The liquid matrix applying device is fixed or stationary i.e. the device does not move relative to the first collecting electrode. E.g. nozzles are fixed at Side A and/or at Side B optionally comprising nozzles between the sides A and B with specific intervals from the wire axis.

We can spin from top to bottom, OR bottom to top, OR top to bottom with a specific angle, OR bottom to top with a specific angle OR vertically from left to right OR vertically from right to left.

FIG. 3 discloses a perspective view of an embodiment of an apparatus according to the invention. This embodiment may illustrate the position of the first collecting electrode and the sheet of substrate both relative to the embodiment of FIG. 1 and of FIG. 2. The first collecting electrode is illustrated as a wire, but the first collecting electrode may e.g. also be shaped bands or a plate or similar. According to this embodiment the sheet of substrate 7 is un-winded from an un-winding unit 17*a* and the sheet of substrate is re-winded or otherwise collected by the re-winding unit 17*b* and it is shown how fine fibers 18 are spun between the second spinning wire electrode and the first collecting electrode 1. A high voltage supply 13 provide an electrostatic field between the first collecting electrode 1 and the second spinning wire electrode 2. The high voltage differential between the electrodes 1 and 2 may be in the order of between 10,000 and 150,000 volts or more, e.g. for the production of fine fibers between 75,000 and 120,000 volts, although other voltage ranges may be possible.

FIGS. 4A, 4B, 4C and 4D illustrate different embodiments of the position of the sheet of substrate 7 and the first collecting electrode and the second spinning wire electrode.

According to the embodiment of FIG. 4A the first path which the sheet of substrate 7 is travelling along is horizontal, the single second spinning wire electrode 2 travels along a second path which is at constant distance d to the surface of the sheet of substrate 7, i.e. the second path is also horizontal, the second path is positioned below the sheet of substrate 7 and the first collecting electrode 1 is positioned above the sheet of substrate 7.

According to the embodiment of FIG. 4B the first path which the sheet of substrate 7 is travelling along is also horizontal, the single second spinning wire electrode 2 again travels along a second path which is at constant distance d to the surface of the sheet of substrate 7, i.e. the second path is horizontal. The second path is positioned above the sheet of substrate 7 and the first collecting electrode 1 is positioned below the sheet of substrate 7.

According to the embodiment of FIG. 4C the first path which the sheet of substrate 7 is travelling along is inclined, the single second spinning wire electrode 2 travels along a second path which is at constant distance d to the surface of the sheet of substrate 7 and therefore the second path is inclined at the same angle. The second path is positioned below the sheet of substrate 7 and the first collecting electrode 1 is positioned above the sheet of substrate 7.

According to the embodiment of FIG. 4D the first path which the sheet of substrate 7 is travelling along is inclined, the single second spinning wire electrode 2 travels along a second path which is at constant distance d to the surface of the sheet of substrate 7 and therefore the second path is inclined at the same angle. The second path is positioned above the sheet of substrate 7 and the first collecting electrode 1 is positioned below the sheet of substrate 7.

Figure 5A:
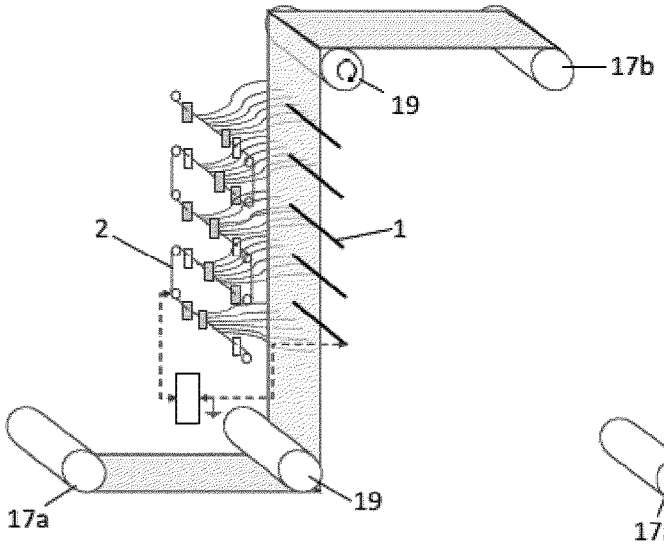
FIGS. 5A and 5B disclose different embodiments of an apparatus according to the invention.
Figure 5B:
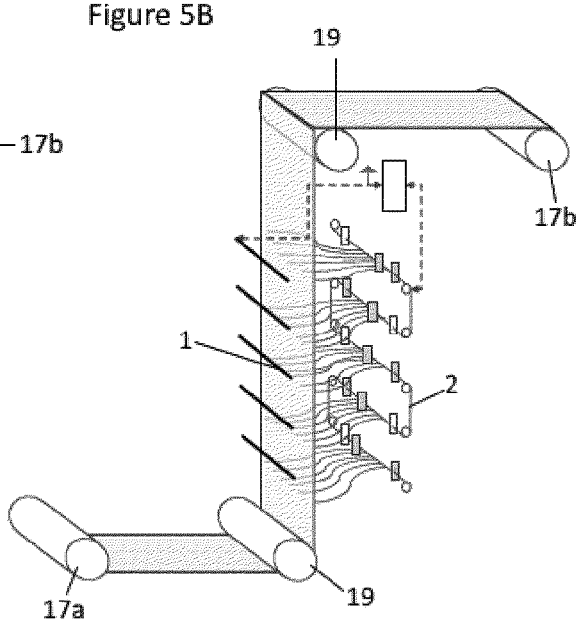

FIGS. 5A and 5B illustrate two embodiments of an apparatus according to the invention where the sheet of substrate 7 is extending in a vertical direction during operation i.e. the first path is extending in a vertical direction. Both embodiments may comprise intermediate guiding means 19 e.g. in the form of guiding rollers which guide the sheet of substrate from the un-winding unit 17*a*, through the operational area, and forward to the winding unit 17*b*. As the second spinning wire electrode must maintain an approximately constant distance to the sheet of substrate, the second path of the second spinning wire electrode 2 is also extending in a vertical direction. In the embodiment of FIG. 5A, the second spinning wire electrode 2 is positioned on the left side of sheet of substrate 7 while the first collecting electrode 1 is position on the right side of the sheet of substrate 7. In the embodiment of FIG. 5B, the second spinning wire electrode 2 is positioned on the right side of sheet of substrate 7 while the first collecting electrode 1 is position on the left side of the sheet of substrate 7.

| Ref. no. | Ref. name |
|---|---|
| 1 | First collecting electrode |
| 2 | Second spinning wire electrode |
| 3 | First guiding means |
| 4 | Secondary guiding means |
| 5 | Tertiary guiding means |
| 6 | Wire driving unit |
| 7 | Sheet of substrate |
| 8 | Wire cleaning device |
| 9 | Vacuum head |
| 10 | Arrow indicating second direction |
| 11 | Arrow indicating fourth direction |
| 12 | Liquid matrix application device such as a nozzle |
| 13 | High voltage supplier |
| 14 | Guiding means guiding second spinning wire electrode from last position to first position |
| 15 | Un-winding unit for second spinning wire electrode |
| 16 | Winding or collecting unit for second spinning wire electrode |
| 17a, 17b | Un-winding unit and winding unit for substrate |
| 18 | Fibers such as nanofibers |
| 19 | Intermediate guiding means for sheet of substrate |

The invention claimed is:

1. An apparatus for producing fibers by electrospinning liquid matrix in an electrostatic field onto a sheet of substrate, comprising:

a first collecting electrode (1);

one second spinning wire electrode (2) spaced from the first collecting electrode, the one second spinning wire electrode (2) comprising a moving strand or wire guided by first guiding means (3);

a wire driving unit (6, 15, 16) moving the one second spinning wire electrode (2) forward; and a liquid matrix application device (12) applying liquid matrix to the one second spinning wire electrode (2);

the sheet of substrate (7) travels along a first path in a first direction between the first collecting electrode (1) and the one second spinning wire electrode (2); and the one second spinning wire electrode (2) travels in a second direction (10) substantially perpendicular to the first direction at a substantially constant operational distance to the sheet of substrate (7);

wherein the apparatus comprises one or more secondary guiding means (4) guiding the one second spinning wire electrode (2) in a third direction at least partly parallel to the first direction i.e. parallel to the travelling direction of the sheet of substrate, and tertiary guiding means (5) guiding the one second spinning wire electrode (2) in a fourth direction (11) substantially perpendicular to the first direction and parallel but opposite the second direction (10) at a constant operational distance to the sheet of substrate (7) wherein the constant operational distance is the same when travelling in the second direction (10) and when travelling in the fourth direction.

2. The apparatus according to claim 1, wherein the apparatus comprises a wire cleaning device (8) removing wet or dry liquid matrix from the one second spinning wire electrode.

3. The apparatus according to claim 2, wherein the apparatus comprises vacuum heads (9) positioned in connection with each wire cleaning device (8) removing cleaned/peeled of dry or wet liquid matrix.

4. The apparatus according to claim 1, wherein the liquid matrix application device (12) is constituted by at least one nozzle applying liquid matrix to a surface of the one second spinning wire electrode (2), while the one second spinning wire electrode passes one or more stationary nozzles of the at least one nozzle.

5. The apparatus according to claim 4, wherein the at least one nozzle is fixed at a side of the sheet of substrate, or the at least one nozzle is placed in between each side of the sheet of substrate, or both fixed at a side and placed in between each side of the sheet of substrate.

6. The apparatus according to claim 1, wherein the one second spinning wire electrode (2) is made of stainless steel or an equivalent conductive material having a diameter greater than 0.1 mm.

7. The apparatus according to claim 1, wherein the liquid matrix is a polymer solution prepared by using one or a combination of polymers of PA6, PA66, PA12, PAN, PU, PES, PEO, PET, PP, PE, PVDF, PUR, and a solvent chosen from acetic acid, formic acid, ethanol, tetrahydrofuran, DMA and/or DMF.

8. The apparatus according to claim 1, wherein the apparatus further comprises an un-winding unit (15) feeding the one second spinning wire electrode to a first guiding means (3) and a winding unit (16) collecting the one second wire electrode (2) that is collectable after a tertiary guiding means (5);

where either the un-winding unit (15) or the winding unit (16) constitutes the wire driving unit (15, 16).

9. The apparatus according to claim 1, wherein the one second spinning wire electrode (2) is constituted of a continuous wire which is continuously driven round through the apparatus by the wire driving unit (6).

* * * * *